US011355273B2

(12) United States Patent
Nogues Barrieras et al.

(10) Patent No.: US 11,355,273 B2
(45) Date of Patent: Jun. 7, 2022

(54) NON-LIQUID IMMERSED TRANSFORMERS WITH IMPROVED COIL COOLING

(71) Applicant: HITACHI ENERGY SWITZERLAND AG, Baden (CH)

(72) Inventors: Antonio Nogues Barrieras, Saragossa (ES); Rafael Murillo, Saragossa (ES); Martín Carlos Roy, Saragossa (ES); Lorena Cebrian, Saragossa (ES); Luis Sanchez Lago, Saragossa (ES)

(73) Assignee: Hitachi Energy Switzerland AG, Baden (CH)

( * ) Notice: Subject to any disclaimer, the term of this patent is extended or adjusted under 35 U.S.C. 154(b) by 376 days.

(21) Appl. No.: 16/492,805

(22) PCT Filed: Mar. 7, 2018

(86) PCT No.: PCT/EP2018/055631
§ 371 (c)(1),
(2) Date: Sep. 10, 2019

(87) PCT Pub. No.: WO2018/162568
PCT Pub. Date: Sep. 13, 2018

(65) Prior Publication Data

US 2020/0388430 A1 Dec. 10, 2020

(30) Foreign Application Priority Data

Mar. 10, 2017 (EP) ..... 17382123

(51) Int. Cl.
*H01F 27/12* (2006.01)
*H01F 27/24* (2006.01)
(Continued)

(52) U.S. Cl.
CPC ..... *H01F 27/12* (2013.01); *H01F 27/24* (2013.01); *H01F 27/2876* (2013.01); *H01F 27/324* (2013.01)

(58) Field of Classification Search
CPC ..... H01F 27/12; H01F 27/24; H01F 27/2876; H01F 27/324; H01F 27/322; H01F 27/10; H01F 27/327
See application file for complete search history.

(56) References Cited

U.S. PATENT DOCUMENTS 2,388,565 A * 11/1945 Paluev ..... H01F 27/322 336/57
2,544,845 A 3/1951 Link
2016/0035488 A1 2/2016 Sarver et al.

FOREIGN PATENT DOCUMENTS

CN 1244284 A 2/2000
CN 1279812 A 1/2001
(Continued)

OTHER PUBLICATIONS

Notification of the First Office Action and Search Report, dated Jul. 2, 2021, Chinese Patent Application No. 2018800170846, 7 pages.
(Continued)

*Primary Examiner* — Tuyen T Nguyen
(74) *Attorney, Agent, or Firm* — Sage Patent Group

(57) ABSTRACT

A non-liquid immersed transformer including a magnetic core having a winding axis and at least two coil windings wound around the magnetic core along the winding axis. One or more cooling tubes made of dielectric material are arranged inside at least one of the coil windings to cool down the coil winding using dielectric fluid flowing through the dielectric cooling tubes. Each cooling tube is wound continuously forming one or more complete loops around the core.

18 Claims, 5 Drawing Sheets

(51) Int. Cl.
*H01F 27/28* (2006.01)
*H01F 27/32* (2006.01)

(56) References Cited

FOREIGN PATENT DOCUMENTS

| | | | | | |
|---|---|---|---|---|---|
| CN | 105448479 | A | | 3/2016 | |
| CN | 105513763 | A | | 4/2016 | |
| CN | 105742026 | A | | 7/2016 | |
| JP | S59222912 | A | | 12/1984 | |
| JP | 60057604 | A | * | 4/1985 | ..... H01F 27/10 |
| JP | H0737724 | A | | 2/1995 | |
| WO | 9834241 | A1 | | 8/1998 | |
| WO | 9928926 | A2 | | 6/1999 | |
| WO | WO 2016/074928 | A1 | | 5/2016 | |

OTHER PUBLICATIONS

European Patent Office, International Search Report & Written Opinion issued in corresponding Application No. PCT/EP2018/055631, dated Jun. 5, 2018, 13 pp.
European Patent Office, Extended Search Report & Written Opinion issued in corresponding Application No. 17382123.2, dated Sep. 25, 2017, 8 pp.
Search Report dated Jan. 29, 2022, Chinese Patent Application No. 2018800170846, 3 pages.

* cited by examiner

NON-LIQUID IMMERSED TRANSFORMERS WITH IMPROVED COIL COOLING

FIELD OF INVENTION

The present disclosure relates to cooling for non-liquid immersed transformers. In particular, the present disclosure relates to transformers comprising arrangements for cooling at least a coil winding.

BACKGROUND

As is well known, a transformer converts electricity at one voltage level to electricity at another voltage level, either of higher or lower value. A transformer achieves this voltage conversion using a primary coil and a secondary coil, each of which are wound around a ferromagnetic core and comprise a number of turns of an electrical conductor. The primary coil is connected to a source of voltage and the secondary coil is connected to a load. The ratio of turns in the primary coil to the turns in the secondary coil ("turns ratio") is the same as the ratio of the voltage of the source to the voltage of the load.

Other types of transformers are also well known and are called multiwinding transformers. Such transformers use multiple windings connected in series or in parallel or independently depending on the desired functionality of the transformer.

It is widely known that transformers may suffer from temperature rises during operation. These temperature issues have to be avoided or at least reduced as low as possible in order to achieve a better performance and a longer life of the transformer.

A particular type of transformers is a non-liquid immersed transformer. Typically, non-liquid immersed transformers use a gas such as air to refrigerate for instance the winding or coils thereof. This air cooling may be forced or natural. In case of forced-air cooling the blowing equipment may be positioned to blow the airflow to the windings. Such non-liquid immersed transformers are also called dry-type transformers because they do not use liquid either as insulating medium or for cooling.

It is also known the use of hollow conductors in the coils of the transformer and then water is forced to circulate through the interior of the conductor. Other known solutions use metallic serpentines placed between the turns of a coil. In such cases, the metallic serpentine is grounded. That implies that the insulation between the turns and the serpentine has to withstand the voltage of the coil. Both solutions are mostly used for low voltage coils.

It has now been found that it is possible to provide an improved cooling arrangement for non-liquid immersed or dry-type transformers, which allows to properly refrigerate the winding and may be more efficient and can be applied also to relatively high voltages contrary to known solutions.

SUMMARY

In a first aspect, a non-liquid immersed transformer is provided. The non-liquid immersed transformer comprises a magnetic core having a winding axis, at least two coil windings wound around the magnetic core along the winding axis, and at least one cooling tube made of dielectric material arranged inside at least one of the coil windings to cool down the coil winding using dielectric fluid flowing through the cooling tube made of dielectric material, wherein said at least one cooling tube is continuously wound forming one or more completed loops around the magnetic core.

The provision of one or more dielectric cooling tubes arranged inside the coil windings allows reducing as much as possible the temperature rises caused in the winding when the transformer is in operation. Therefore the performance and the lifespan of the transformer may be improved.

In some examples, at least one of the coil windings comprises turns made of electricity conducting material, preferably aluminium or copper, and the cooling tube(s) is(are) encapsulated in epoxy resin.

In some examples, at least one of the coil windings may comprise foil windings having foil turns and the dielectric cooling tube(s) is(are) continuously wound forming one or more completed loops around the magnetic core, preferably helicoidally, placed in a space defined between turns of the foil winding and crossing the conductor through holes made in the foil winding or through holes of a metallic piece which is joined, preferably welded, between the turns defining the space. This allows for cheaper and more compact transformers as the cooling winding is interlaced with the coil windings. In some examples, spacers may be placed between the different set of turns to create a space where the cooling tubes are placed.

In some examples, at least one of the coil windings may comprise foil-disk windings or CTC-disk windings and the dielectric cooling tube(s) is (are) continuously wound forming one or more completed loops around the core, preferably helicoidally, located in spaces between the disks.

In some examples, at least one of the coil windings may comprise helical or layer winding as conductor wire or continuously transposed conductors (CTC) and the dielectric cooling tube(s) is (are) continuously wound forming one or more completed loops around the core, preferably helicoidally, with the dielectric tubes placed between turns of the helical winding or in spaces between the layers of the layer winding.

In some examples the least one cooling tube comprises a single tube continuously wound forming one or more completed loops around the core.

Alternatively the at least one cooling tube comprises a plurality of tubes connected in parallel using fittings and each cooling tube of the plurality of tubes is wound continuously forming one or more completed loops around the core.

Such fittings may also be made of dielectric material.

In some further examples, the non-liquid immersed transformer further comprises a cooling circuit to supply fresh dielectric fluid to the cooling tube(s) made of dielectric material. Alternatively, the cooling circuit may be external to the transformer and the transformer may comprise connectors to connect to the external cooling circuit. The cooling circuit, external or internal, comprises at least a pump, a heat-exchanger, such as a liquid-liquid heat-exchanger or a liquid-air heat-exchanger, and a liquid-reservoir.

In some examples, the dielectric cooling liquid used in the cooling tubes may be an ester fluid, such as Midel®, Biotemp® or Envirotemp®. In other examples the dielectric fluid may be a silicone fluid, or a non-flammable fluid, preferably a fluorinated fluid, such as Novec® or Fluorinert®, or a mineral or natural oil.

In some examples the cooling tube(s) are made of plastic material, preferably selected from the group consisting of cross-linked polyethylene (PEX), polyphenylsulfone (PPSU), polybutylene (PB), polytetrafluoroethylene (PTFE) or silicone.

BRIEF DESCRIPTION OF THE DRAWINGS

Non-limiting examples of the present disclosure will be described in the following, with reference to the appended drawings, in which.

DETAILED DESCRIPTION OF EXAMPLES

Figure 1:
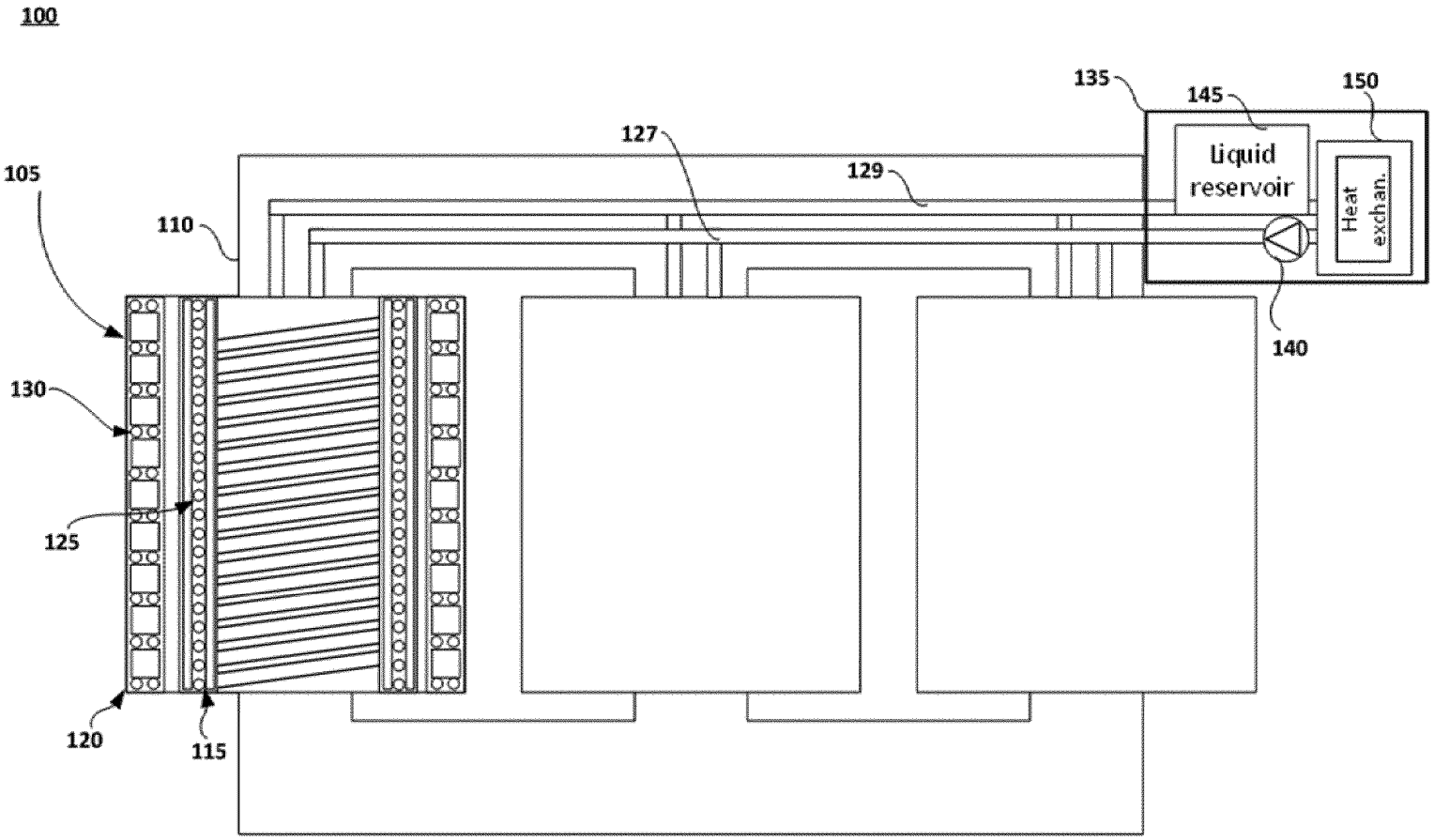
FIG. 1 is a schematic partial and sectional view of a transformer comprising cooling tube(s) according to an exemplary embodiment.

FIG. 1 is a schematic sectional view of a transformer comprising one or more cooling tubes according to the present invention. The transformer of FIG. 1 may be a non-liquid immersed three-phase transformer. The non-liquid immersed transformer 100 may comprise three phases each with a set of windings and arranged around an associated core leg. In the following description, reference will be made to just one electric phase for the sake of simplicity but what described is likewise applicable to each of the phases. For example, a first phase 105 comprises a core leg 110, an inner coil winding 115, an outer coil winding 120. At least one cooling tube made of dielectric material is arranged inside at least one of the coil windings 115, 120 to cool down the coil winding using dielectric fluid flowing through the cooling tube itself and the cooling tube is wound continuously forming one or more completed loops around the magnetic core. In particular, the cooling tube is continuously wound around the core inside the associated coil winding 115 or 120 forming the one or more completed loops.

In the exemplary embodiment illustrated in FIG. 1, a first cooling tube 125 and a second cooling tube 130 are used. The inner coil winding 115 may be a low voltage (LV) winding surrounding the core 110. The inner coil winding 115 may be a foil winding. The first cooling tube winding 125 is wound forming one or more completed loops around the core leg 110, preferably in a helical form, placed between the turns of the foil winding. The outer coil winding 120 may be a high voltage (HV) winding surrounding the inner coil winding 115. The outer coil winding 120 may be a foil-disk winding. The second cooling tube 130 is also wound forming one or more completed loops around the core leg 110, preferably in a helical manner, passing from spaces between disks in the dome area through the external part of the outer coil winding. The cooling tubes 125, 130 may be connected to an external circuit 135. The external circuit may comprise a pump 140, a heat-exchanger 145 and a liquid reservoir 150. The pump 140 may force liquid from the reservoir 150 to the cooling tube windings 125 and 130 through feeding tube 127. The liquid may then be warmed when it passes through the cooling tubes 125 and 130 and return to the external circuit through return tube 129. When the liquid returns warmer it may pass through heat exchanger 145 where the excess heat may be dissipated. The liquid may then return to the liquid reservoir 150.

As indicated, the cooling liquid to be used in the cooling tubes may be any type of suitable dielectric fluid. Preferably it can be an ester fluid, such as Midel®, Biotemp® or Envirotemp®. In other examples the dielectric fluid may be a silicone fluid, or a non-flammable fluid, preferably a fluorinated fluid, such as Novec® or Fluorinert®, or a mineral or natural oil.

The cooling tubes may be made of dielectric material. For example, it may be made of plastic material, preferably selected from the group consisting of cross-linked polyethylene (PEX), polyphenylsulfone (PPSU), polybutylene (PB), polytetrafluoroethylene (PTFE) or silicone.

Figure 2A:
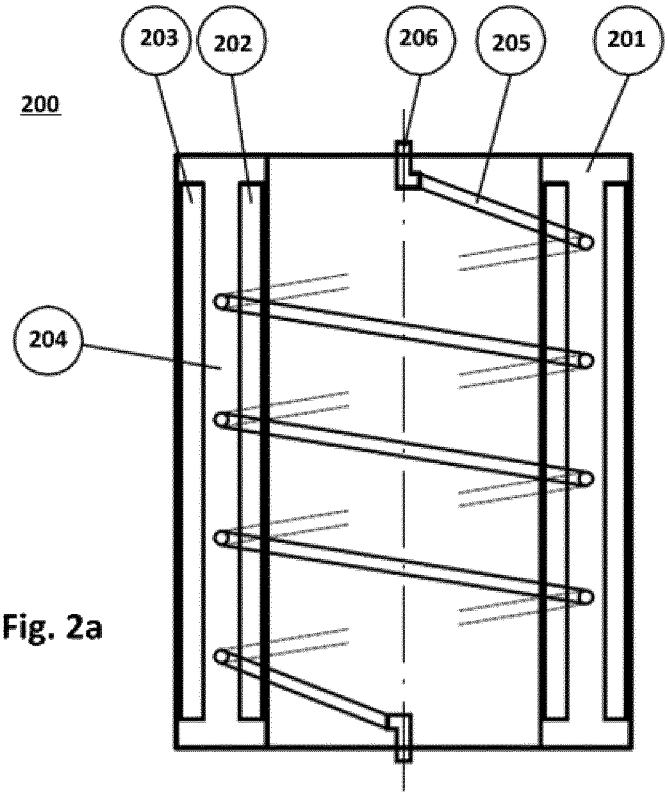
FIGS. 2*a*-2*b* are schematic views of an exemplary transformer comprising a foil winding coil with the cooling tube(s) wound inside the coil continuously forming one or more completed loops in a helical configuration.
Figure 2B:
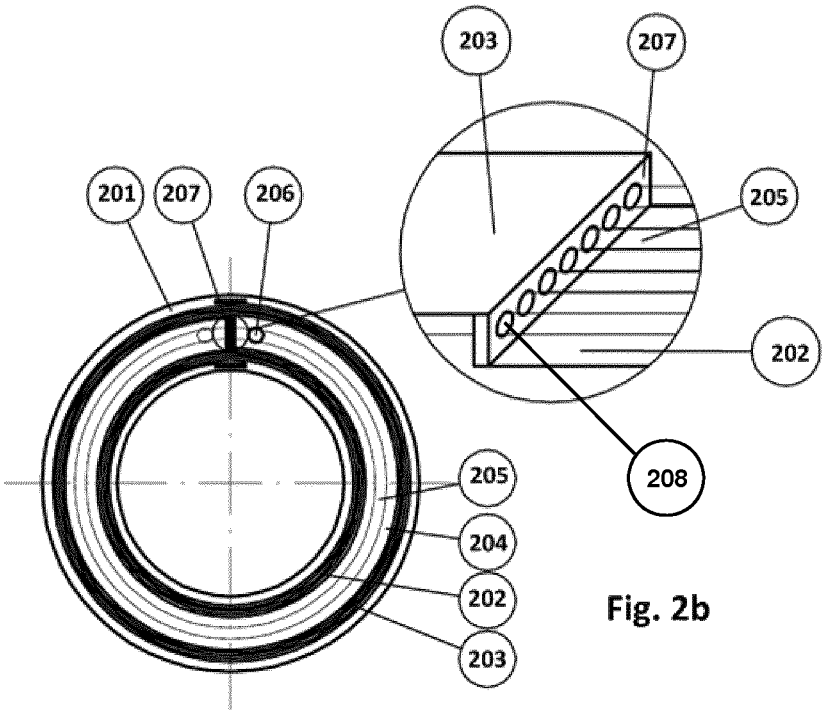

FIG. 2*a* and FIG. 2*b* are schematic views of a transformer comprising a foil winding coil with at least one cooling tube continuously wound forming one or more completed loops around the core, preferably in a helical configuration. The foil winding may comprise turns made of electricity conducting material, preferably aluminum or copper, and all together with the cooling tube(s) are preferably encapsulated in epoxy resin 201. More specifically, the coil winding comprises a first set of turns 202 and a second set of turns 203. Between the turns a space 204 is present. The space 204 may be maintained by spacers (not shown). A cooling tube 205 is wound continuously forming one or more completed loops around the core, arranged preferably in a helical manner, and located in the space 204. The extremes of the cooling tube 205 may be coupled to a pair of connectors 206. The connectors may be used to connect the cooling tube 205 to an external circuit similar to the external circuit 135 described with reference to FIG. 1. The external circuit may then provide cooling dielectric liquid to the cooling tube 205. In a more preferred embodiment, consecutive coil winding turns, such as the turns 202 and 203 illustrated in FIG. 2*b* are connected, e.g. welded, with a corresponding metallic piece 207 which is interposed there between. A suitable number of metallic pieces 207 is provided in the coil winding, and each preferably comprises through holes 208. A cooling tube 205 passes through holes of the metallic piece 207, as shown in FIG. 2*b*. Alternatively, the cooling tube(s) is/are wound continuously forming one or more completed loops around the core placed in a space defined between turns of the foil winding and crossing the conductive foil turns through holes made in the foil windings themselves.

Figure 3A:
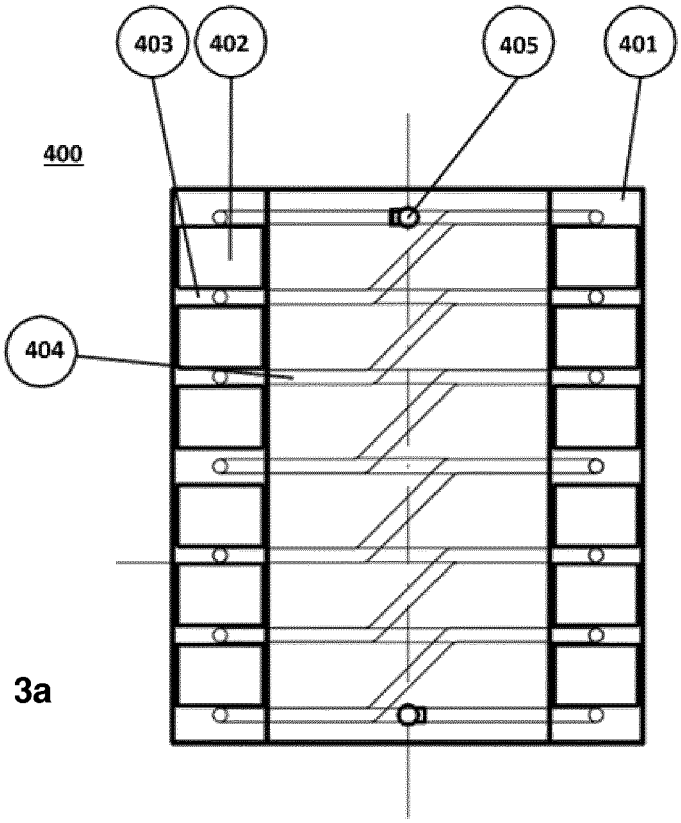
FIGS. 3*a*-3*b* are schematic views of a transformer comprising a foil-disk or CTC-disk winding coil with the cooling tubes placed in the space between disks.
Figure 3B:
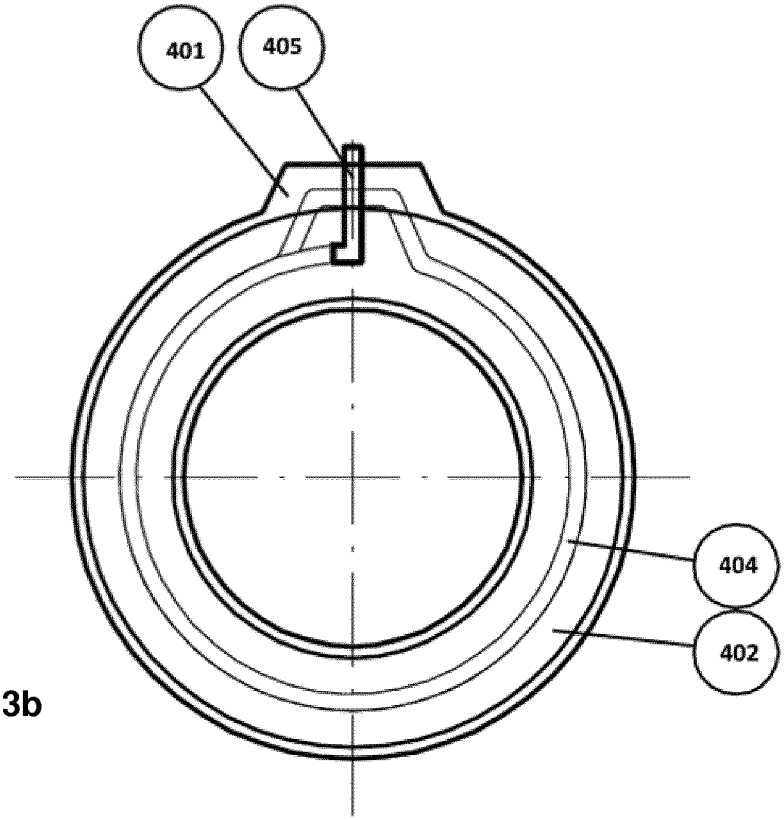

FIG. 3*a* and FIG. 3*b* are schematic views of a transformer comprising a foil-disk or CTC-disk winding with the cooling tube(s) wound continuously forming one or more completed loops around the core, preferably in a helical configuration. The coil 400 of the example of FIG. 3*a* may comprise a disk winding and cooling tube 404. The disk winding may comprise disks 402 made of electricity conducting material, preferably aluminum or copper, and the cooling tube(s) together with the coil winding are all encapsulated in epoxy resin 401. More specifically, the disk winding may comprise a series of discs 402. The disks 402 may be separated by spaces 403 present between two adjacent disks 402. The cooling tube 404 is placed in the space between the disks and it may protrude outwards, passing over the disk between two consecutive spaces in order place the cooling duct in the consecutive space between disks. The extremes of the cooling tube 404 may be coupled to a pair of connectors 405. The connectors 405 may be used to connect the cooling tube 404 to an external circuit (not shown) similar to the external circuit 135 discussed with reference to FIG. 1. The external circuit may then provide cooling dielectric liquid to the cooling tube 404.

Figure 4A:
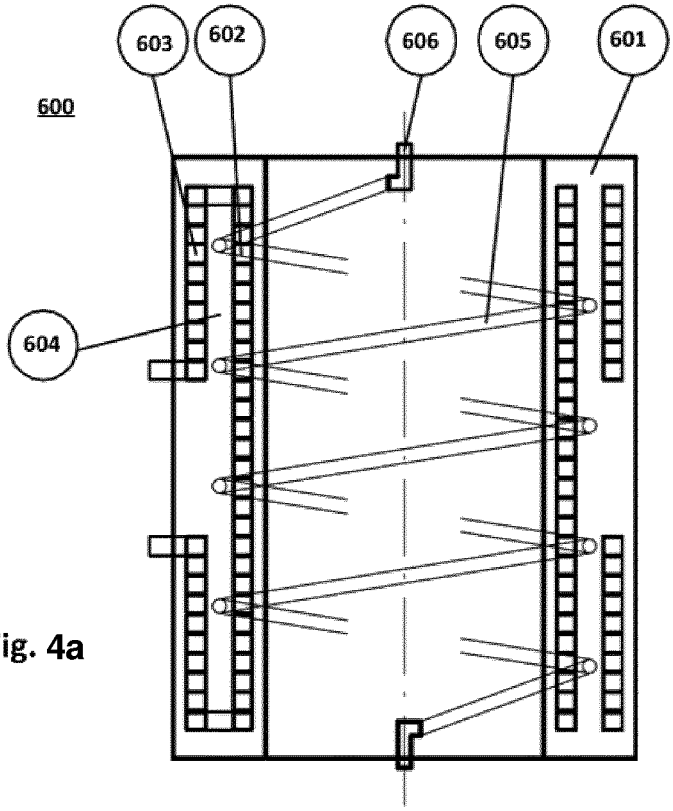
FIGS. 4*a*-4*b* are schematic views of an exemplary transformer comprising a strand or CTC layer winding coil with the cooling tube(s) placed in the space between layers in a helical configuration.
Figure 4B:
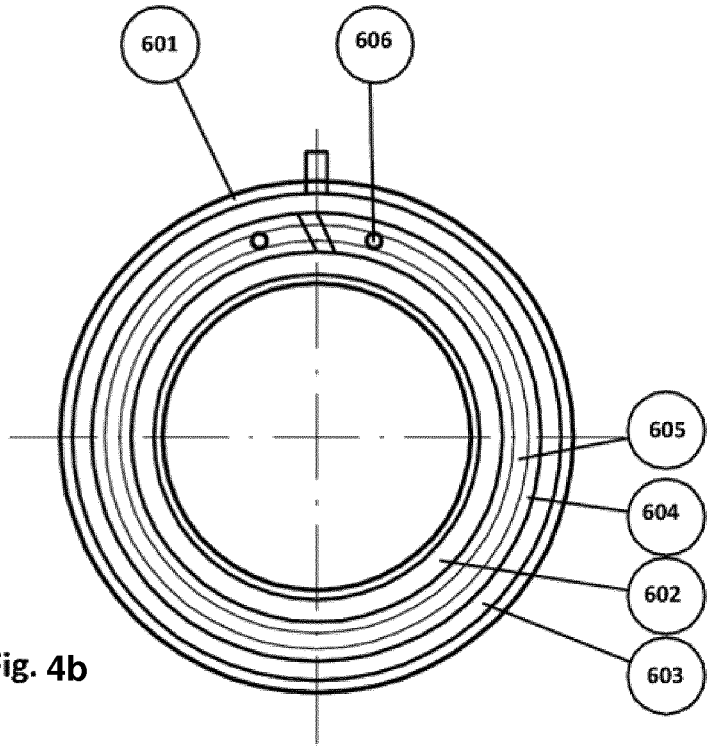

FIG. 4*a* and FIG. 4*b* are schematic views of a transformer comprising a strand or CTC layer winding with the cooling tube(s) 605 wound continuously forming one or more completed loops around the core, preferably in a helical configuration, and placed in the space between layers. The winding may comprise layers made of electricity conducting material, preferably aluminum or copper, and the cooling tube(s) are preferably encapsulated in epoxy resin 601 together with the winding. More specifically, the helical or layer winding may comprise a first layer 602 and a second layer 603. Between the layers a space 604 is present. The space 604 may be maintained by spacers (not shown). A cooling tube 605 is wound forming one or more completed loop around the core, preferably in a helical manner, and arranged in the space 604. The extremes of the cooling tube 605 may be coupled to a pair of connectors 606. The connectors may be used to connect the cooling tube 605 to an external circuit (not shown) similar to the external circuit 135 discussed with reference to FIG. 1. The external circuit may then provide cooling dielectric liquid to the cooling tube 605.

Figure 5A:
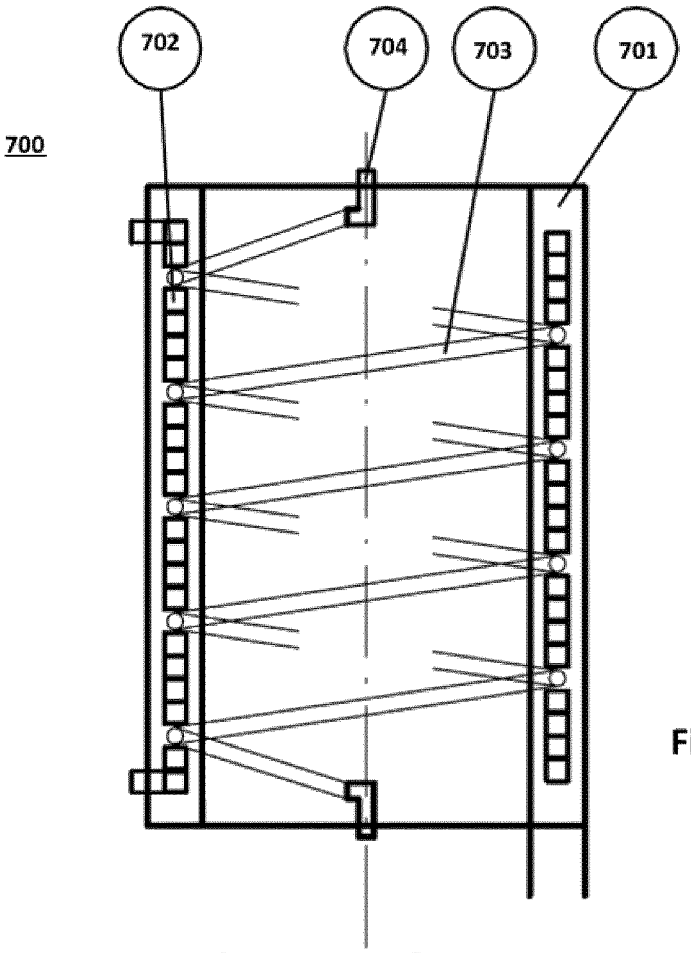
FIGS. 5*a*-5*b* are schematic views of an exemplary transformer comprising a strand or CTC layer winding coil with the cooling tubes placed between turns in a helical configuration.
Figure 5B:
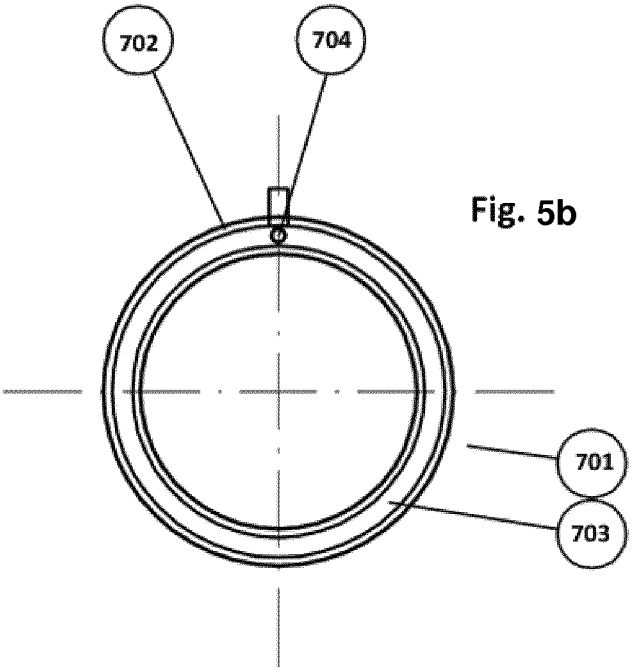

FIG. 5*a* and FIG. 5*b* are schematic views of a transformer comprising a strand or CTC layer winding with cooling tubes 703 placed between turns. The helical or layer winding may comprise a layer winding made of electricity conducting material, preferably aluminum or copper; the winding is encapsulated in epoxy resin 701 together with the cooling tube(s). Within the layer winding 702 a cooling tube 703 is arranged which is wound continuously forming one or more completed loops around the core, preferably in a helical manner. The extremes of the cooling tube 703 may be intercalated between the turns of the layer winding 702. The cooling tube 703 may be coupled to a pair of connectors 704. The connectors 704 may be used to connect the cooling tube 703 to an external circuit (not shown) similar to the external circuit 135 discussed with reference to FIG. 1. The external circuit may then provide cooling dielectric liquid to the cooling tube 703.

The above mentioned examples may be used independently in transformer windings or may be combined. For example, in case of LV/HV transformers, a LV winding normally may comprise a foil winding while the HV winding normally may comprise a disk winding. Accordingly, each of the LV/HV windings may have any of the cooling arrangements discussed with reference to the examples disclosed herein. The cooling arrangements may be independent (i.e. each cooling tube may be connected independently) or in parallel connected to an external circuit.

Thanks to the combination of features of the present invention, and in particular to the implementation of a cooling solution with closed loops made of non-conducting material (tubes and fluid) it is possible to avoid voltage drops in the cooling system, thus preventing generation of high currents in the tube or in the liquid inside the tube as instead possible in prior art solutions. In addition to improve cooling, manufacturing is particularly simplified over known solutions, especially when one single tube is continuously wound around the leg and inside an associated coil winding. The constructive layout is simplified reducing or making even unnecessary to use fittings and connections, thus reducing cost and complexity.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow. If reference signs related to drawings are placed in parentheses in a claim, they are solely for attempting to increase the intelligibility of the claim, and shall not be construed as limiting the scope of the claim.

The invention claimed is:

1. A non-liquid immersed transformer comprising:

a magnetic core having a winding axis;

at least two coil windings wound around the magnetic core along the winding axis;

at least one cooling tube made of dielectric material arranged inside at least one of the coil windings to cool down the coil winding using dielectric fluid flowing through the cooling tube made of dielectric material, wherein said at least one cooling tube is continuously wound forming one or more complete loops around the magnetic core, and wherein at least one of the coil windings comprises foil windings having foil turns and said at least one cooling tube is helicoidally wound continuously forming one or more complete loops around the core placed in a space defined between turns of the foil winding and passing into through holes provided on a metallic piece interposed between and joining adjacent turns.

2. The non-liquid immersed transformer according to claim 1, wherein at least one of the coil windings comprises turns made of electricity conducting material and encapsulated in epoxy resin together with the at least one cooling tube.

3. A non-liquid immersed transformer comprising:

a magnetic core having a winding axis;

at least two coil windings wound around the magnetic core along the winding axis;

at least one cooling tube made of dielectric material arranged inside at least one of the coil windings to cool down the coil winding using dielectric fluid flowing through the cooling tube made of dielectric material, wherein said at least one cooling tube is continuously wound forming one or more complete loops around the magnetic core, and wherein at least one of the coil windings comprises foil windings having foil turns and said at least one cooling tube is helicoidally wound continuously forming one or more complete loops around the core placed in a space defined between turns of the foil winding and crossing the conductive foil turns through holes made in the foil windings.

4. A non-liquid immersed transformer comprising:

a magnetic core having a winding axis;

at least two coil windings wound around the magnetic core along the winding axis;

at least one cooling tube made of dielectric material arranged inside at least one of the coil windings to cool down the coil winding using dielectric fluid flowing through the cooling tube made of dielectric material, wherein said at least one cooling tube is continuously wound forming one or more complete loops around the magnetic core, and wherein at least one of the coil windings comprises foil-disk windings or CTC-disk windings and the at least one cooling tube is located in a space between disks, wherein any two cooling tube portions located at consecutive spaces are connected by passing the tube over the disk between two consecutive spaces.

5. The non-liquid immersed transformer according to claim 1, wherein at least one of the coil windings comprises helical or layer winding as strand wire or continuously transposed conductors (CTC) and the at least one cooling tube is wound helicoidally forming one or more complete loops around the core and placed between turns of the helical winding or in spaces between the turns of the layer winding.

6. The non-liquid immersed transformer according to claim 1, wherein said at least one cooling tube comprises a single tube wound continuously forming one or more complete loops around the core.

7. The non-liquid transformer according to claim 1, wherein said at least one cooling tube comprises several tubes connected in parallel using fittings and each wound continuously forming one or more complete loops around the core.

8. The non-liquid immersed transformer according to claim 1, further comprising a cooling circuit to supply fresh dielectric fluid to the at least one cooling tube, wherein the cooling circuit comprises at least a pump and a heat-exchanger.

9. The non-liquid immersed transformer according to claim 1, wherein the dielectric fluid is one of an ester fluid, a silicone fluid, a non-flammable fluid, and a mineral or natural oil.

10. The non-liquid immersed transformer according to claim 1, wherein the at least one cooling tube is made of plastic material.

11. The non-liquid immersed transformer according to claim 10, wherein the at least one cooling tube is made of plastic material selected from the group consisting of cross-linked polyethylene (PEX), polyphenylsulfone (PPSU), polybutylene (PB), polytetrafluoroethylene (PTFE) or silicone.

12. The non-liquid immersed transformer according to claim 1, comprising a first cooling tube to cool a primary coil winding and wound continuously forming one or more complete loops around the core inside said primary coil winding and a second cooling tube to cool a secondary coil winding and wound continuously forming one or more complete loops around the core inside said secondary coil winding.

13. The non-liquid immersed transformer according to claim 1, wherein the primary coil winding is a high voltage winding and the secondary coil winding is a low voltage winding.

14. A three-phase transformer comprising non-liquid immersed transformers according to claim 1.

15. A non-liquid immersed transformer comprising:

a magnetic core having a winding axis;

at least two coil windings wound around the magnetic core along the winding axis; and at least one cooling tube made of dielectric material arranged inside at least one of the coil windings to cool down the coil winding using dielectric fluid flowing through the cooling tube made of dielectric material, wherein said at least one cooling tube is continuously wound forming one or more complete loops around the magnetic core, wherein at least one of the coil windings comprises turns made of electricity conducting material and encapsulated in epoxy resin together with the at least one cooling tube, and wherein at least one of the coil windings comprises foil windings having foil turns and said at least one cooling tube is helicoidally wound continuously forming one or more complete loops around the core placed in a space defined between turns of the foil winding and crossing the conductive foil turns through holes made in the foil windings.

16. A non-liquid immersed transformer comprising:

a magnetic core having a winding axis;

at least two coil windings wound around the magnetic core along the winding axis; and at least one cooling tube made of dielectric material arranged inside at least one of the coil windings to cool down the coil winding using dielectric fluid flowing through the cooling tube made of dielectric material, wherein said at least one cooling tube is continuously wound forming one or more complete loops around the magnetic core, wherein at least one of the coil windings comprises turns made of electricity conducting material and encapsulated in epoxy resin together with the at least one cooling tube, and wherein at least one of the coil windings comprises foil-disk windings or CTC-disk windings and the at least one cooling tube is located in a space between disks, wherein any two cooling tube portions located at consecutive spaces are connected by passing the tube over the disk between two consecutive spaces.

17. The non-liquid immersed transformer according to claim 2, wherein at least one of the coil windings comprises helical or layer winding as strand wire or continuously transposed conductors (CTC) and the at least one cooling tube is wound helicoidally forming one or more complete loops around the core and placed between turns of the helical winding or in spaces between the turns of the layer winding.

18. The non-liquid immersed transformer according to claim 2, wherein said at least one cooling tube comprises a single tube wound continuously forming one or more complete loops around the core.

* * * * *